US006367733B1

(12) United States Patent
McLaughlin

(10) Patent No.: US 6,367,733 B1
(45) Date of Patent: Apr. 9, 2002

(54) CORE CHUCK

(76) Inventor: James McLaughlin, 7900 Madison Pike #12005, Madison, AL (US) 35758

( * ) Notice: Subject to any disclaimer, the term of this patent is extended or adjusted under 35 U.S.C. 154(b) by 0 days.

(21) Appl. No.: 09/256,142

(22) Filed: Feb. 24, 1999

Related U.S. Application Data

(60) Provisional application No. 60/110,536, filed on Dec. 2, 1998.

(51) Int. Cl.[7] ..... B65H 75/24
(52) U.S. Cl. ..... 242/575.3; 242/571.6
(58) Field of Search ..... 242/571.6, 575.3, 242/575.4; 279/2.19

(56) References Cited

U.S. PATENT DOCUMENTS

| | | | | | |
|---|---|---|---|---|---|
| 3,337,151 | A | * | 8/1967 | Parkinson | 242/68.2 |
| 3,593,933 | A | * | 7/1971 | Grashorn | 242/46.4 |
| 3,811,632 | A | * | 5/1974 | Bassett | 242/46.4 |
| 4,635,872 | A | * | 1/1987 | Thievessen | 242/72 R |
| 4,893,765 | A | * | 1/1990 | Randolph | 242/72 R |
| 5,490,640 | A | * | 2/1996 | Miller et al. | 242/572 |
| 5,524,849 | A | * | 6/1996 | Dorfel et al. | 242/571 |

* cited by examiner

*Primary Examiner*—John Q. Nguyen
(74) *Attorney, Agent, or Firm*—Womble Carlyle Sandridge & Rice

(57) ABSTRACT

A core chuck has a generally spool-shaped mandrel with an outer surface configured to define three longitudinally extending lobes. A set of three or more arcuate friction plates surround the lobular outer surface of the mandrel and are movably held in place with elastic bands. Each friction plate has an inner surface contoured to conform to the shape of a corresponding lobe of the mandrel and an outer surface for frictionally engaging the inside surface of a core. The outer surfaces of the friction plates align to form a cylindrical shell. The friction plates are circumferentially slidable around the mandrel between first or retracted positions wherein the plates rest on their respective lobes and form a shell of a first diameter and second or expanded positions wherein the friction plates span adjacent lobes and form a shell of a second diameter greater than the first diameter. In use, a core chuck is inserted in each end of the hollow core of a roll of material and a shaft is inserted through and secured to the chucks. Relative rotational movement between the roll and the chucks in either direction causes the friction plates to slide toward their second positions, expanding outwardly and frictionally engaging the inside surface of the core. Driving or tensioning forces applied to the shaft are thus transferred to the entire roll through the chucks.

17 Claims, 3 Drawing Sheets

CORE CHUCK

REFERENCE TO RELATED APPLICATION

This application claims the benefit of the filing date of U.S. Provisional patent application Ser. No. 60/110,536 filed on Dec. 2, 1998.

TECHNICAL FIELD

This invention relates generally to handling industrial rolls of web or sheet material such as large rolls of carpet, textiles, paper, plastic, and the like. More specifically, the invention relates to core chucks insertable in the cores of such rolls for gripping the cores tightly to apply driving or braking forces to the rolls as material is wound onto or drawn from the rolls.

BACKGROUND OF THE INVENTION

Bulk quantities of web or sheet material are often supplied in large rolls wound about a hollow tubular core made of paperboard or plastic. When working with such rolls in a manufacturing facility, there is often a need to mount the rolls on spindles so that material can be wound onto or drawn from the rolls. For example, newspaper publishers usually draw newsprint paper from large rolls and carpet suppliers store carpet on and remove it from large carpet rolls. Many other types of web materials such as non-wovens are also stored on rolls.

When material is being wound onto a roll, it typically is necessary to rotate the core of the roll during the winding process. Conversely, when material is being drawn or from a roll for use in a manufacturing process, it usually is necessary to apply a breaking or tensioning force to the roll to keep the material taut and to prevent freewheeling of the roll and resultant spillage of material. Historically, mounting rolls of sheet and web material on a spindle to allow the application of driving or tensioning forces has been accomplished with core chucks and shafts. A core chuck is a device that is inserted in the ends of the tubular core of a roll and, through some mechanism, grips the core so that forces applied to the chuck through the spindle or shaft is transferred to the core and to the roll. A core shaft is similar to a core chuck but extends completely through the core of the roll, thus serving both as the chuck assembly and the shaft.

Many types of core chucks and core shafts are available. One simple type is known as a core plug. A typical core plug is a conical section-shaped plug made of metal or plastic with serrations or teeth formed on its conical outer surface. In use, a core plug is forced into each end of a core until it is tight. The spindle shaft is then extended through and secured to the plugs such that driving or tensioning forces applied to the shaft are transferred to the roll through the plugs. While core plugs offer the advantage of-simplicity, they nevertheless are plagued with certain inherent problems and shortcomings, primary among which is their tendency to tear and destroy cores during operation. Core plugs also tend to slip and spin out within their cores, especially when used with large heavy rolls of material such as carpet or paper rolls. Core plugs are therefore generally limited to light duty applications.

Another type of available core chuck is known as the pneumatic or air chuck. Air chucks generally are provided with plates, leaves, or lugs that overlie an inflatable bladder or bladders within the chuck. In use, air chucks are inserted into a core and their internal bladders are inflated with an external source of compressed air or fluid. Inflation of the bladders in turn urges the overlying leaves outwardly into locking frictional contact with the interior wall of the core. Air chucks are also available in the form of air shafts, which extend completely through a core and incorporate or include the spindle shaft.

While air chucks and shafts work relatively well in most material roll cores, they too have their problems and shortcomings. Key among these problems is the expense, complexity, and high maintenance costs of the chucks and shafts. In addition, air chucks are inefficient because they require an external source of compressed air or fluid, which must be maintained, and require operator intervention for inflation and deflation. Finally, when used with heavy rolls of material such as rolls of carpet or steel, air chucks tend to cause the roll to rotate a bit off center. This is because the weight of the roll compresses the portion of the bladder beneath the top leaves of the chuck, which causes a distension of the portion of the bladder beneath the bottom leaves. Accordingly, air chucks and shafts generally are not suited to situations where heavy rolls of material are to be rotated at relatively high speeds.

Another type of core chuck is the mechanical chuck. In a typical mechanical chuck, an array of lugs, bars, dogs, or leaves, or an elastic shell is mechanically urged outwardly into gripping or frictional contact with the interior wall of a roll core to couple the chuck to the core. While mechanical core chucks can also be successful, they have their own set of problems. In many mechanical chucks, for example, an array of relatively small lugs are urged outwardly and pierce the wall of the core or grip it with jaw-like projections. These aggressive locking mechanisms can cause the core to rip and tear especially under heavy loads and large forces. Most mechanical chucks engage the interior of a core at several discrete locations rather than over a large area. As a result, driving and tensioning forces are transferred to the core through relatively small areas of contact, which, again, can cause the cores to tear and be destroyed. While mechanical chucks typically are somewhat less expensive and less troublesome to use than air chucks, they nevertheless tend to have many working parts and can require periodic maintenance and part replacement. Because of their complex mechanisms, some mechanical core chucks engage in only one direction, requiring that the chucks be removed and reversed if it is desired to drive or tension a roll in the opposite direction.

Mechanical core chucks also include elastic shell chucks, wherein a rubberized or elastic shell is expanded into engagement with the interior of a roll core by an eccentric internal shaft. These types of chucks, while transferring force over a larger area, tend to loose their grip when a driving or tensioning force is temporarily removed and can be somewhat sluggish in operation because of the elasticity of the rubberized shell.

Some examples of mechanical core chucks illustrative of the types discussed above are disclosed in U. S. Pat. No. 5,490,640 of Grashorn; U.S. Pat. No. 3,337,151 of Parkinson; U.S. Pat. No. 3,811,632 of Bassett; U.S. Pat. No. 4,893,765 of Randolph; U.S. Pat. No. 5,524,849 of Dorfel et al.; U.S. Pat. No. 5,683,057 of Gangemi; and U.S. Pat. No. 5,490,640 of Miller et al. The devices of these patents exhibit one or more of the forgoing problems.

Accordingly, there exists a need for an improved core chuck that is simple to use, automatic in operation, that operates equally well in both rotational directions of a roll, does not require application of pressurized air or fluid, and that require virtually no maintenance. It is to the provision of such a core chuck that the present invention is primarily directed.

SUMMARY OF THE INVENTION

Briefly described, the present invention, in one preferred embodiment thereof, comprises an improved core chuck for coupling a roll of web material to a spindle such that driving or tensioning forces can be coupled to the roll. The chuck includes an elongated generally spool-shaped main body or mandrel having first and second ends and an outer surface. The outer surface of the mandrel is formed with a set of longitudinally extending lobes, with the preferred embodiment having a set of three or more lobes. A set of arcuate friction plates are mounted on and substantially surround the outer surface of the mandrel. Together, the friction plates form a shell around the mandrel. Each friction plate has an interior surface for engaging the longitudinally extending lobes and an exterior surface for frictionally engaging the inside surface of a core in which the chuck is disposed. The materials from which the mandrel and plates are fabricated are chosen so that the coefficient of friction between the friction plates and the outer surface of the mandrel is less than the coefficient of friction between the friction plates and the inside surface of a core.

The interior surface of each friction plate is contoured to conform to the shape of a corresponding one of the lobes and the exterior surfaces of the friction plates align to form a cylindrical outermost surface of the chuck. The friction plates are held in place on the mandrel by a pair of elastic bands extending around the friction plates and preferably nestled in aligned annular grooves formed in the plates. In this way, the friction plates are held securely to the mandrel but are nevertheless free to slide around the mandrel and expand against the elasticity of the bands. The friction plates are thus circumferentially slidable around the mandrel between first positions wherein the friction plates are disposed on respective ones of the lobes forming a shell of a first diameter and second positions wherein the friction plates span adjacent lobes forming a shell of a second diameter greater than the first diameter.

In use, a pair of chucks with friction plates in their first or retracted positions are inserted into the ends of the core of a roll of material. A shaft can then be extended through and secured to the chucks for mounting the roll on a spindle. Alternatively, in shaftless systems, the roll is mounted on a pair of spaced opposed chucks secured to a spindle and no shaft extends through the roll. In situations where material is to be drawn from the roll, the shaft or spindle is coupled to a breaking mechanism for applying a tensioning force to the roll.

As material is drawn from the roll, the roll and its core rotate relative to the chucks. Since the friction between the core and friction plates is greater than the friction between the friction plates and the mandrel, this relative rotation causes the friction plates to slide around the mandrel toward their second or expanded positions. As the friction plates slide and expand, they engage firmly against the inner surface of the core thereby frictionally locking the core to the chucks. Tensioning forces applied to the shaft are thus conveyed to the core through the chucks to prevent free-wheeling of the roll as material is drawn therefrom.

When the roll is empty or needs to be removed, a slight rotation of the core in the opposite direction causes the friction plates to slide back to their retracted positions and the chucks can be removed easily from the core. Further rotation in the opposite directions causes the friction plates to slide up onto adjacent lobes to expanded positions in the opposite direction, again frictionally locking against the inner surface of the core. Thus, the chuck of this invention functions equally well in either rotational direction.

The same principles apply when relative motion between the chucks and the core is caused by a driving force applied to the shaft. This commonly occurs when material is being wound onto a core rather than being drawn from it. The relative rotational motion again locks the chucks frictionally to the core for transferring the driving force. The chuck of this invention thus is equally useful in situations where large rolls are driven for winding material around a core and to situations where a tensioning force is applied to rolls as material is drawn from the rolls. Further, since the friction plates of the chucks expand evenly, the center of rotation of the chuck remains aligned with the center of mass of the roll, preventing unbalanced rotation.

Accordingly, it is seen that an improved core chuck is now provided that successfully addresses the problems and shortcomings of the prior art. The chuck is simple in construction and operation, requires virtually no maintenance, is highly reliable, and requires no external source of compressed air or fluid for its operation. Further, the chuck cannot tear or destroy a core because its friction plates engage the inner surface of the core over a large surface area rather than with small lugs or dogs as used in many prior art chucks. These and other features, objects, and advantages of the invention will become more apparent upon review of the detailed description set forth below taken in conjunction with the accompanying drawings, which are briefly described as follows.

DETAILED DESCRIPTION OF THE PREFERRED EMBODIMENT

Figure 1:
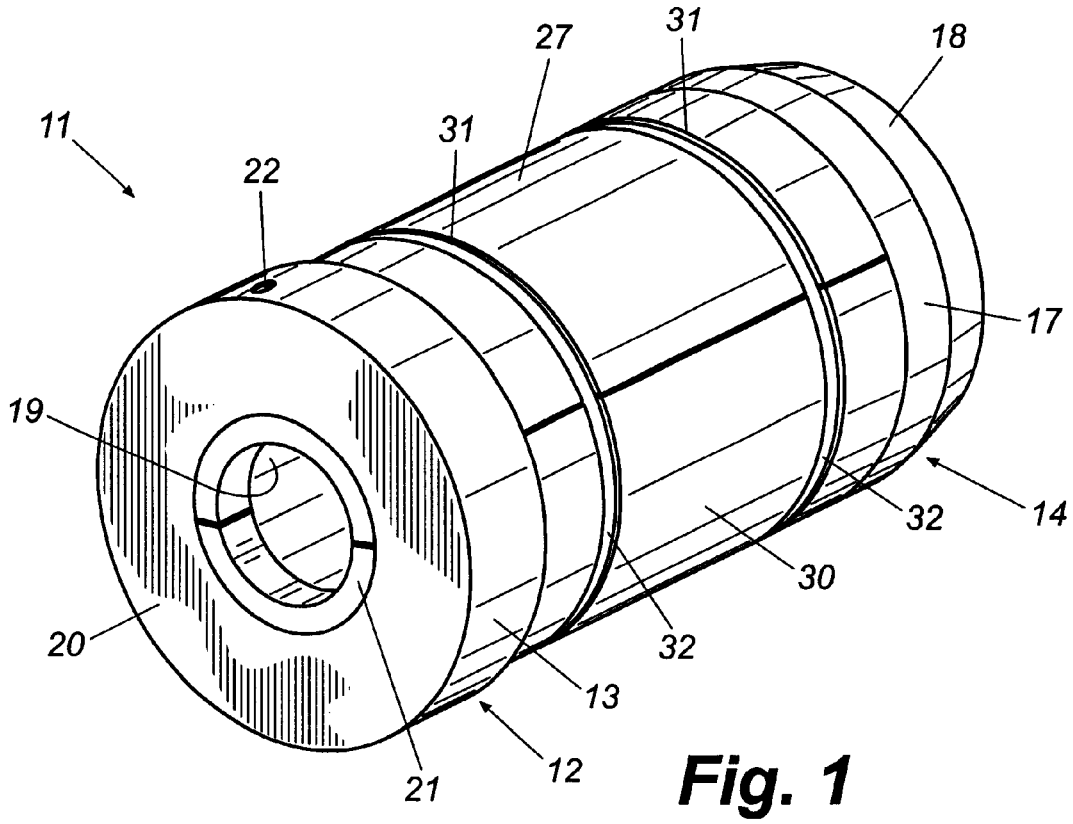
FIG. 1 is a perspective view of a core chuck that embodies principles of the present invention in a preferred form.

Referring now in more detail to the drawings, wherein like numerals refer to like parts throughout the several views, FIG. 1 is a perspective representation of a core chuck that embodies principals of the present invention in a preferred form. The core chuck 11 comprises a generally spool-shaped main body or mandrel 12 having a proximal end portion 13 with a flat head 16 and a distal end portion 14. The mandrel 12 is fabricated of steel or aluminum in the preferred embodiment, but could just as well be fabricated from a number of other appropriate materials such as other metals or plastics and all appropriate materials are contemplated by this invention. The distal end portion 14 of the mandrel 12 has a generally frusto-conical shape defined by a cylindrical section 17 and a conical section 18. Such a shape provides a tapered end and facilitates the insertion of the core chuck 11 into the end of a tubular core.

An axially extending bore 19 is formed through the mandrel 12 from the proximal end to the distal end thereof.

The bore 19 is sized to receive a shaft for mounting a roll of material to a spindle. In some cases, the shaft extends completely through a core and through the core chuck in each end. In other cases a separate shaft may be provided at each end of the roll so that a shaft does not extend through the core. In either case, drive means and/or tensioning means usually are provided for driving the shaft to rotate the roll or for applying tensioning force to the shaft for tensioning the roll against freewheeling as material is drawn from the roll.

An annular recess 20 (FIG. 2) is formed in the bore at the proximal end portion of the mandrel. The recess 20 is sized to receive a shaft clamp mechanism, which, in the preferred embodiment, comprises a pair of split rings 21 that can be securely clamped to a shaft by a set screw 23 disposed in a threaded boss 22. The shaft clamp mechanism shown in the preferred embodiment is a standard and widely used device and is preferred because of its simplicity and because it does not tend to gouge or score the shaft. However, various alternative means of clamping the core chuck to a shaft might be employed and the illustrated shaft clamp should be understood to be exemplary and preferred but not limiting.

Figure 2:
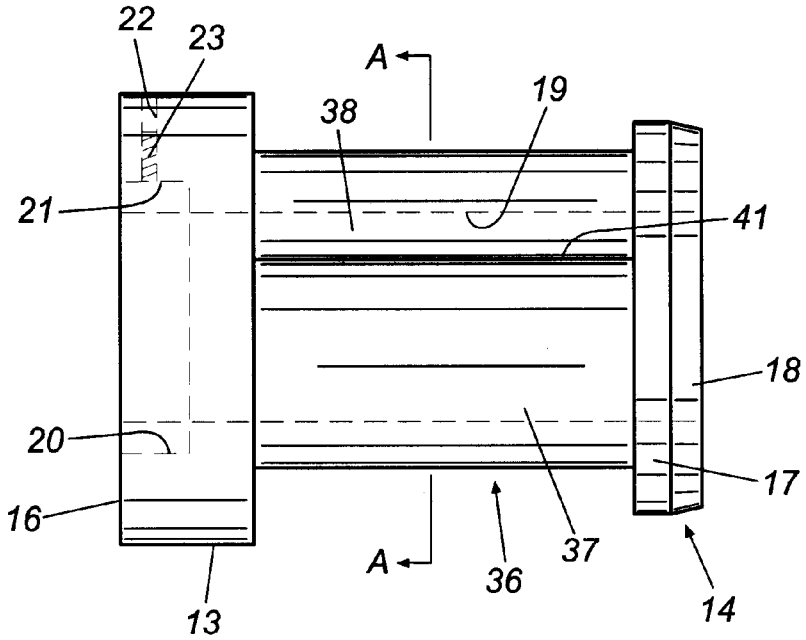
FIG. 2 is a side elevational view of the mandrel portion of the core chuck illustrating the lobbed outer surface thereof.
Figure 3:
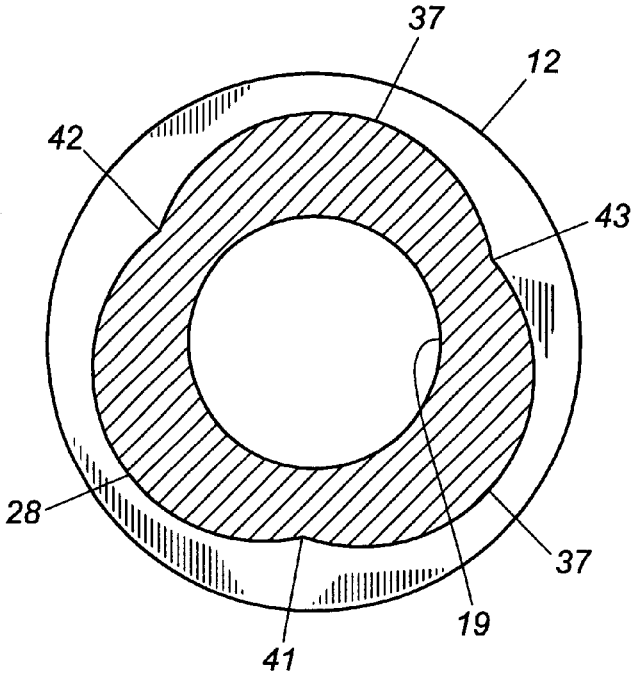
FIG. 3 is a cross sectional view of the mandrel of FIG. 2 taken along A—A and illustrating better the lobed outer surface of the mandrel.

Referring now to FIGS. 2 and 3, the mandrel 12 has a central portion with an outer surface 36 that extends between the proximal and distal ends 13 and 14 respectively. The outer surface 36 is formed with a set of three longitudinally extending lobes 37, 38, and 39, which meet one another at junctions 41, 42, and 43 (FIG. 3). Each of the lobes have a radius and is a section of a cylinder with a central axis radially offset from the central axis of the mandrel.

Figure 4:
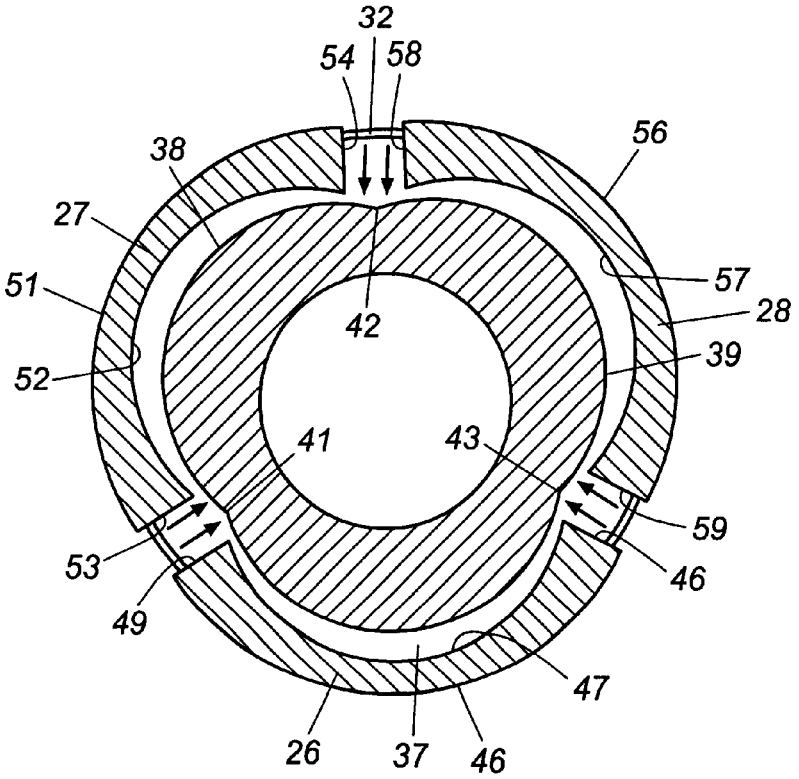
FIG. 4 is a cross sectional view of the core chuck showing the contoured inner and outer surfaces of the friction plates and their relationship to the lobes of the mandrel.

FIG. 4 illustrates in cross-section the configuration of friction plates 26, 27, and 28 and their relationship to the lobes 37, 38, and 39. Friction plate 26 is generally arcuate in shape having an interior surface 47, an exterior surface 46, a first edge 48 and a second edge 49. The interior surface 47 is contoured to conform to the shape of a corresponding one of the lobes, specifically lobe 37 in FIG. 4. In other words, the interior surface of friction plate 26 is also a section of a cylinder with a radius equal to the radius of the lobe 37. In this way, friction plate 26 fits conformingly over lobe 37 with its edge portions 48 and 49 disposed at lobe junctions 43 and 41 respectively.

Similarly, friction plate 47 has an interior surface 52, an exterior surface 51, and edges 53 and 54. The interior surface of friction plate 27 is contoured as a section of a cylinder with a radius corresponding to the radius of lobe 38 and fits on lobe 38 in the same way as friction plate 26 fits on lobe 37. Finally, like the other friction plates, friction plate 28 has an interior surface 57, an exterior surface 56, and edges 58 and 59. The interior surface of friction plate 28 is contoured as a section of a cylinder with a radius corresponding to the radius of lobe 39 and thus fits on lobe 39 with its edges disposed at lobe junctions 42 and 43. In the preferred embodiment, the lobes are all formed with the same radius; however, this should not be considered a limitation of the invention.

The friction plates 26, 27, and 28 preferably are fabricated of brass because the coefficient of friction between the brass plates and steel mandrel is relatively low whereas the coefficient of friction between the brass plates and the inside wall of a paperboard core is high. While brass has been found to be preferred, it should be understood that a wide variety of other materials including, without limitation, bronze, copper, aluminum, steel, ceramics, or plastic may be acceptable under various conditions and all appropriate materials are considered to be within the scope of the present invention. Regardless of the material chosen, it is important that the coefficient of friction between the friction plates and the mandrel be less than the coefficient of friction between the friction plates and the interior wall of a core in which the core chuck is to be disposed.

The friction plates 26, 27, and 28 are mounted on the mandrel 12 and are movably and expandably secured by a pair of elastic bands 32 (FIGS. 1 and 4) that extend around the friction plates to hold them in place. Preferably, the elastic bands 32 are disposed in corresponding aligned annular grooves 31 formed in the exterior surfaces of the friction plates. The annular grooves are formed with a depth greater than the thickness of the elastic bands so that the elastic bands are fully received in the grooves and do not protrude from the outer surface of the friction plates. The elastic bands are thus protected against abrasion and wear since they are prevented from engaging the interior surface of a roll core in which the chuck is disposed. In FIG. 4, the friction plates are illustrated slightly exploded from the outer surface of the mandrel so that all elements are clearly visible. It should be understood, however, that the friction plates normally are drawn to and held against the outer surface of the mandrel by the elastic action of the bands 32, as indicated by the small arrows in FIG. 4.

Figure 5:
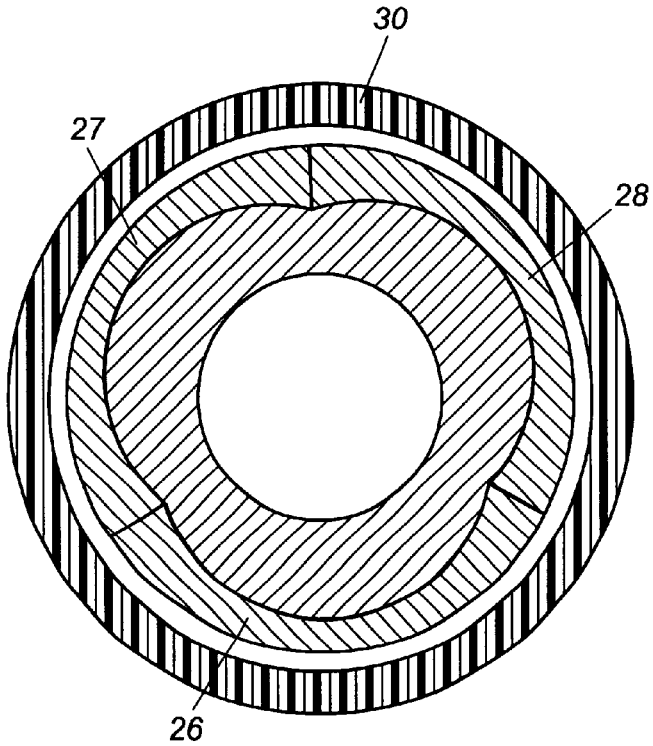
FIG. 5 is a cross sectional view of the chuck showing the friction plates in their first or retracted positions disposed on respective lobes of the mandrel.
Figure 6:
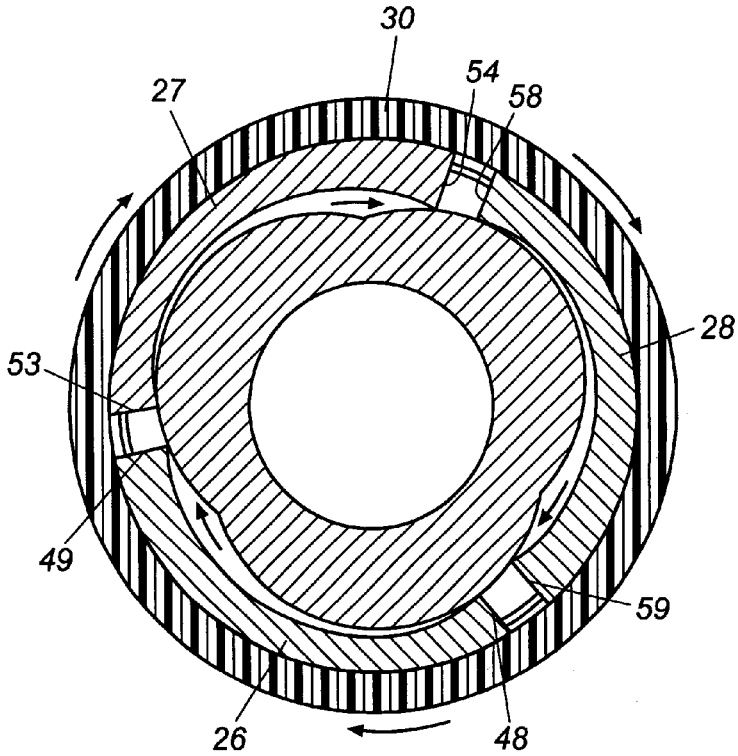
FIG. 6 is a cross sectional view of the chuck showing the friction plates in their second or expanded positions spanning adjacent lobes of the mandrel.

FIGS. 5 and 6 illustrate in cross-section the action of the core chuck 11 of the present invention inside a core 30. As illustrated in FIG. 5, the core chuck is initially inserted distal end first into the end of a core 30 until the proximal end portion of the core chuck abuts the end of the core. In some instances, the proximal end of the chuck is not formed with a shoulder and the chuck is designed to be inserted completely into the core. In either case, since the core chuck is under no circumferential stress prior to and during insertion, its friction plates 26, 27, and 28 are held by the elastic bands in their first or retracted positions atop respective ones of the longitudinally extending lobes of the mandrel. Preferably, the outer diameter of the shell formed by the friction plates in this position is slightly less than the inner diameter of the core so that the core chuck fits snuggly in the core but can be inserted and removed with relative ease.

Once the core chucks are in place in the ends of the core, a shaft is inserted through the core and through the central bores of the core chucks on each end of the core and is secured within the chucks by means of the shaft clamps 21. The roll of material can then be rotatably mounted on a spindle or support frame. Rotational motion of the roll of material is therefore transferred through the core chucks to the shaft and vice versa.

FIG. 6 illustrates action of the core chuck 11 in a situation where a tensioning force is applied to the shaft and material is drawn from the roll for use in a manufacturing process. It will be understood that a similar action occurs when the shaft is driven to rotate the roll for winding material about the core, it being the relative rotational motion between the core and the chucks that is important.

As the roll begins to rotate in response to material being drawn therefrom, the friction between the inside surface of the core and the friction plates begins to drag or slide the friction plates around the mandrel in the direction of rotation of the roll. This occurs because the coefficient of friction between the friction plates and the mandrel is less than the coefficient of friction between the friction plates and the inside surface of the core and because the mandrel is held in place by the tensioning force applied to the shaft. As the friction plates slide around the mandrel, they are progressively dislodged from atop their respective lobes and their end portions begin to ride up onto their own lobe and the next adjacent lobe. Each friction plate thus progressively spans two adjacent lobes of the mandrel. The riding of the friction plates up onto the lobes as shown in FIG. 6 causes the friction plates to move radially outwardly with respect to the mandrel and thus to move into firm frictional engagement with the interior surface of the core 30. At some point, the rotational force applied to the roll overcomes the tensioning force of the shaft and the chucks and shaft are rotated along with the roll against the tensioning force as material is drawn from the roll. As mentioned above, this prevents freewheeling of the roll as the material is drawn at different speeds or stopped.

It will be seen that the core chuck of this invention operates equally well in either rotational direction of the roll. When a roll is rotated in a direction opposite from that shown in FIG. 6, the friction plates simply ride up on their corresponding lobes and the adjacent lobe on the other side thereof and otherwise the function is the same. When it is desired to remove the roll or an empty core, the core is simply rotated in a reverse direction until the friction plates slide and retract back to their rest positions on respective ones of the lobes, whereupon the core can be pulled out of the core. The elastic bands tend to pull the friction plates back toward their rest positions and hold them there when the core chuck is not in use.

Unlike prior art mechanical and air chucks, the friction plates of the present invention engage the inside surface of a core over a large area substantially entirely around the circumference of the core. Thus, while the same tensioning or driving forces are imparted to the core as with prior art chucks, these forces are transferred to the core over a substantially larger area, thereby eliminating the tearing and core destruction common with prior art chucks. An additional benefit of the action of applicant's chuck is that the chuck automatically centers itself within the core during use and holds the centered position regardless of the weight or size of the roll of material. This represents a distinct advantage over air chucks and shafts, which, as mentioned above, tend to become off-centered as the weight of a material roll increases.

The preferred embodiment of the invention discussed above takes the form of a core chuck for insertion in the ends of a roll core. However, the invention is also applicable to and intended to encompass a shaft that extends completely through the core to eliminate the need for a separate shaft. In such a configuration, the lobed outer surface of the mandrel and the friction plates might extend the entire length of the shaft. Alternatively, shorter sections of friction plates might be disposed at intervals along the shaft. In either event, the principles of the invention apply.

The invention has been described herein in terms of preferred embodiments and methodologies, which illustrate the best mode known to the inventor of carrying out the invention. It will be understood by those of skill in the art, however, that various additions, deletions, and modifications might be made to the illustrated embodiments within the bounds of the invention. For example, the preferred materials for the mandrel and the friction plates has been disclosed as steel and brass respectively. A variety of other materials might well be substituted with comparable results, so long as the coefficient of friction between the friction plates and the mandrel is less than the coefficient of friction between the friction plates and the inside surface of the core. In this regard, a rubber coating might be applied to the exterior surfaces of the friction plates to increase the friction between the friction plates and the core. Such a coating would permit a wider range of materials for the mandrel and friction plates themselves.

The invention has been disclosed with three friction plates that ride on three lobes formed in the outer surface of the mandrel. While three plates and lobes are preferred and are believed to be the most efficient configuration, more or less than three friction plates and lobes might be used depending on the intended use of the invention. Finally, a shaft clamp has been disclosed as the preferred method of securing the core chuck to a shaft. Other methods of securing the chuck to a shaft such as, for example, set screws or keyway or square shafts, might be substituted and the shaft clamp of the preferred embodiment should not be considered a limitation of the invention. These and other additions, deletions, and modifications might well be made to the preferred embodiments without departing from the spirit and scope of the invention as set forth in the claims.

What is claimed is:

1. A core chuck comprising:

an elongated mandrel having a longitudinal axis, a first end, a second end, and an outer surface defining a set of longitudinally extending lobes from said first and to said second end;

a set of arcuate friction plates mounted on and together defining a shell about said mandrel, each of said friction plates having an interior surface for engaging said lobes and an exterior surface for engaging the inside of a core in which said core chuck is disposed, said interior surface of each of said friction plates being contoured to conform to the shape of a corresponding one of said lobes;

said friction plates being circumferentially slidable about said mandrel between a first position wherein said friction plates form a shell having a first diameter and a second position wherein said friction plates form a shell having a second diameter greater than said first diameter;

each of said friction plates being disposed on a corresponding lobe of said mandrel in said first position, and spanning a pair of adjacent lobes in said second position;

said core chuck being insertable in and removable from a core when said friction plates are in said first position and being frictionally locked within the core when said friction plates are in said second position.

2. A core chuck as claimed in claim 1 and further comprising at least one expandable retainer extending about said friction plates for movably holding said friction plates in place on said mandrel.

3. A core chuck as claimed in claim 2 and wherein said expandable retainer comprises an elastic band residing in an annular groove formed around said exterior surfaces of said friction plates.

4. A core chuck as claimed in claim 3 and wherein said at least one elastic band comprises two elastic bands.

5. A core chuck as claimed in claim 1 and wherein the materials from which said mandrel and said friction plates are fabricated are chosen such that the coefficient of friction between said friction plates and said mandrel is less than the coefficient of friction between said friction plates and the interior of a core.

6. A core chuck as claimed in claim 5 and wherein said mandrel and said friction plates are fabricated of plastic.

7. A core chuck as claimed in claim 5 and further comprising a coating on said exterior surfaces of said friction plates to enhance the coefficient of friction between said friction plates and the core.

8. A core chuck as claimed in claim 5 and wherein said mandrel and said friction plates are fabricated of metal.

9. A core chuck as claimed in claim 8 and wherein said mandrel is fabricated of steel and said friction plates are fabricated of brass.

10. A core chuck comprising an elongated mandrel having a central axis and an outer surface defining a set of longitudinally extending lobes, a set of arcuate friction plates movably secured on and together forming a shell around said mandrel, said friction plates being circumferentially slidable around said mandrel between a first position, wherein said friction plates are positioned on respective ones of said lobes and together define a shell of a first diameter and a second position, wherein said friction plates are positioned to span adjacent lobes and define a shell of a second diameter larger than said first diameter, and wherein said lobes are sections of cylinders having respective radii and having axes that are radially offset from said central axis of said mandrel, each of said friction plates having an interior surface having a radius corresponding to the radii of said lobes.

11. A core chuck receivable in a roll core for exertion of a tensioning force on the core, said core chuck comprising:

an elongated body having a longitudinal axis and an outer surface that defines a set of longitudinally extending lobes;

a set of elongated arcuate friction plates disposed about said outer surface of said elongated body;

each of said friction plates having an inner surface contoured to conform to the shape of a corresponding one of said lobes and an outer surface for frictionally engaging the interior of a roll core;

said friction plates being circumferentially slidable on said outer surface between a first position wherein said friction plates rest on corresponding lobes and together define a shell of a first diameter, and a second position wherein said friction plates span adjacent lobes and together define a shell of a second diameter greater than said first diameter;

said friction plates sliding toward said second position as the roll core rotates on said core chuck to expand said friction plates outwardly against the interior of the roll core for locking said core chuck in place within the roll core.

12. A core chuck as claimed in claim 11 and wherein an outer surface of said body forms three longitudinally extending lobes.

13. A core chuck as claimed in claim 12 and wherein three friction plates are disposed about said outer surface of said elongated body.

14. A core chuck as claimed in claim 13 and wherein said friction plates are movably held in place by at least one elastic band extending around said friction plates.

15. A core chuck as claimed in claim 14 and wherein said body and said friction plates are fabricated of materials chosen to insure that a coefficient of friction between said friction plates and said body is less than a coefficient of friction between the interior of the roll core and said friction plates.

16. A core chuck as claimed in claim 11 and wherein each of said longitudinally extending lobes is a section of a cylinder having an axis radially offset from said longitudinal axis of said mandrel.

17. A core chuck as claimed in claim 16 and wherein said inner surface of each of said friction plates defines a section of a cylinder having a radius substantially corresponding to the radius of a corresponding one of said lobes.

* * * * *